US011114031B2

(12) United States Patent
Ueno

(10) Patent No.: US 11,114,031 B2
(45) Date of Patent: Sep. 7, 2021

(54) DISPLAY DEVICE AND METHOD FOR DRIVING SAME

(71) Applicant: SHARP KABUSHIKI KAISHA, Sakai (JP)

(72) Inventor: Tetsuya Ueno, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/981,660

(22) PCT Filed: Mar. 28, 2018

(86) PCT No.: PCT/JP2018/012754

§ 371 (c)(1),
(2) Date: Sep. 16, 2020

(87) PCT Pub. No.: WO2019/186763

PCT Pub. Date: Oct. 3, 2019

(65) Prior Publication Data

US 2021/0110769 A1 Apr. 15, 2021

(51) Int. Cl.

| | |
|---|---|
| ***G09G 3/3233*** | (2016.01) |
| ***G09G 3/3266*** | (2016.01) |
| ***G09G 3/3275*** | (2016.01) |

(52) U.S. Cl.

CPC ..... *G09G 3/3233* (2013.01); *G09G 3/3266* (2013.01); *G09G 3/3275* (2013.01); *G09G 2300/0819* (2013.01); *G09G 2310/0202* (2013.01); *G09G 2320/0233* (2013.01)

(58) Field of Classification Search

CPC .. G09G 3/3233; G09G 3/3266; G09G 3/3275; G09G 2300/0819; G09G 2310/0202; G09G 2320/0233; G09G 3/20

See application file for complete search history.

(56) References Cited

U.S. PATENT DOCUMENTS

2010/0164847 A1 7/2010 Lee et al.
2012/0001896 A1 1/2012 Han et al.
2014/0313107 A1* 10/2014 Lee ..... G09G 3/3233 345/76

(Continued)

FOREIGN PATENT DOCUMENTS

JP 2011-164133 A 8/2011

*Primary Examiner* — Premal R Patel
(74) *Attorney, Agent, or Firm* — ScienBiziP, P.C.

(57) ABSTRACT

The present disclosure discloses a current-driven display device that uses an internal compensation method and can display a good-quality image with no bright dots that are not included in intended display content. In a pixel circuit of an organic EL display device, a voltage of a gate terminal of a drive transistor is initialized before the voltage of a data signal line is written to a holding capacitor via the diode-connected drive transistors. At this time, an initialization voltage is applied to the gate terminal via a display element initialization transistor, a second light emission control transistor, and a threshold compensation transistor. By initializing the gate terminal with a configuration not including an initialization transistor provided between the gate terminal and an initialization voltage supply line as in the related art, voltage drop at the gate terminal due to leakage current of the transistor in an off state is suppressed.

13 Claims, 11 Drawing Sheets

(56) References Cited

U.S. PATENT DOCUMENTS

| | | | | |
|---|---|---|---|---|
| 2016/0218155 | A1* | 7/2016 | Park | H01L 27/3262 |
| 2017/0141172 | A1* | 5/2017 | Cho | H01L 27/3246 |
| 2019/0122608 | A1* | 4/2019 | Kang | H01L 27/326 |
| 2019/0180677 | A1* | 6/2019 | Hwang | G09G 3/3233 |
| 2019/0228707 | A1* | 7/2019 | Park | G09G 3/3233 |
| 2019/0266928 | A1* | 8/2019 | Kim | G09G 3/32 |
| 2019/0362670 | A1* | 11/2019 | Liu | G09G 3/3233 |

* cited by examiner

DISPLAY DEVICE AND METHOD FOR DRIVING SAME

TECHNICAL FIELD

The disclosure relates to a display device, and more particularly to a current-driven display device including a display element driven by a current, such as an organic electro luminescence (EL) display device, and a method for driving the display device.

BACKGROUND ART

The last few years have seen the implementation of organic EL display devices provided with a pixel circuit including organic EL elements (also referred to as organic light-emitting diodes (OLEDs)). The pixel circuit in such an organic EL display device includes a drive transistor, a write control transistor, and a holding capacitor in addition to the organic EL elements. A thin film transistor is used for the drive transistor and the write control transistor. The holding capacitor is connected to a gate terminal of the drive transistor. A voltage corresponding to an image signal representing an image to be displayed (more specifically, a voltage indicating the gradation values of pixels to be formed by the pixel circuit, hereinafter referred to as "data voltage") is applied to the holding capacitor from the drive circuit via a data signal line. The organic EL element is a self-luminous display element that emits light with luminance according to an electric current flowing through the organic EL element. The drive transistor is connected to the organic EL element in series and controls the electric current passing through the organic EL element according to a voltage held by the holding capacitor.

Variation and fluctuation occur in characteristics of the organic EL element and the drive transistor. Thus, variation and fluctuation in characteristics of these elements need to be compensated in order to perform higher picture quality display in the organic EL display device. For the organic EL display device, a method for compensating a characteristic of an element inside a pixel circuit and a method for compensating a characteristic of an element outside a pixel circuit are known. One known pixel circuit corresponding to the former method is a pixel circuit configured to charge the holding capacitor with the data voltage via the drive transistor in a diode-connected state after initializing voltage at the gate terminal of the drive transistor, that is, the voltage held in the holding capacitor. In such a pixel circuit, variation and fluctuation of the threshold voltage in the drive transistor are compensated for within the pixel circuit (hereinafter, the compensation of variation and fluctuation of threshold voltage is referred to as "threshold compensation").

As described above, an item associated with an organic EL display device that employs a method of threshold compensation in a pixel circuit (hereinafter referred to as an "internal compensation method") is described in, for example, PTL 1. In other words, PTL 1 discloses several pixel circuits configured to charge the holding capacitor with the data voltage via the drive transistor in a diode-connected state after initializing, to a predetermined level, voltage of the gate terminal of the drive transistor, i.e., the voltage held in the holding capacitor. In these pixel circuits, the voltage of the gate terminal connected to the holding capacitor is initialized by applying an initialization power supply VINT via a path including a plurality of transistors (see, for example, FIGS. 4, 8A, and 10).

CITATION LIST

Patent Literature

PTL 1: US Patent Application No. 2012/0001896
PTL 2: JP 2011-164133 A

SUMMARY

Technical Problem

In an organic EL display device employing an internal compensation method, when the pixel circuit is configured as described above to write a data voltage to the holding capacitor via the drive transistor in a diode-connected state after initializing the voltage of the gate terminal of the drive transistor (corresponding to the holding voltage of the holding capacitor), a bright dot that is not included in the intended display content (hereinafter referred to as a "bright dot defect") may occur in the display image.

Because of this, there is a need to display a good-quality image with no bright dot defect in a current-driven display device such as an organic EL display device employing an internal compensation method.

Solution to Problem

A display device according to several embodiments of the disclosure is a display device including a plurality of data signal lines, a plurality of scanning signal lines intersecting the plurality of data signal lines, a plurality of light emission control lines individually corresponding to the plurality of scanning signal lines, and a plurality of pixel circuits arranged in a matrix along the plurality of data signal lines and the plurality of scanning signal lines, the display device including:

first and second power source lines;

an initialization voltage supply line;

a data signal line drive circuit configured to drive the plurality of data signal lines;

a scanning signal line drive circuit configured to selectively drive the plurality of scanning signal lines; and a light emission control circuit configured to drive the plurality of light emission control lines, each pixel circuit including:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and an initialization switching element, in which a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, and the second conduction terminal via the threshold compensation switching element, the first terminal of the display element is connected to the initialization voltage supply line via the initialization switching element, and a second terminal of the display element is connected to the second power source line, and in a period for initializing a holding voltage of the holding capacitor, the threshold compensation switching element, the second light emission control switching element, and the initialization switching element are controlled to an on state, and the write control switching element and the first light emission control switching element are controlled to an off state.

A method for driving a display device according to several other embodiments of the disclosure is a method for driving a display device including a plurality of data signal lines, a plurality of scanning signal lines intersecting the plurality of data signal lines, a plurality of light emission control lines individually corresponding to the plurality of scanning signal lines, first and second power source lines, an initialization voltage supply line, and a plurality of pixel circuits arranged in a matrix along the plurality of data signal lines and the plurality of scanning signal lines, the method for driving a display device including:

an initialization step of initializing each pixel circuit, in which each pixel circuit includes:

a display element driven by a current; a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and an initialization switching element, a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, and the second conduction terminal via the threshold compensation switching element, the first terminal of the display element is connected to the initialization voltage supply line via the initialization switching element, and a second terminal of the display element is connected to the second power source line, and in the initialization step, in a period for initializing a holding voltage of the holding capacitor, the threshold compensation switching element, the second light emission control switching element, and the initialization switching element are controlled to an on state, and the write control switching element and the first light emission control switching element are controlled to an off state.

Advantageous Effects of Disclosure

In some of the above-described embodiments of the disclosure, the pixel circuit is configured such that voltage of the data signal line is applied to the holding capacitor as data voltage via the drive transistor put into a diode-connected state by the threshold compensation switching element, and the holding voltage of the holding capacitor is initialized before the data voltage is written in this way. In addition, in this pixel circuit, the control terminal of the drive transistor is connected to the first power source line via the holding capacitor and the second conduction terminal of the drive transistor via the threshold compensation switching element, the second conduction terminal is connected to the first terminal of the display element via the second light emission control switching element, and the first terminal of the display element is connected to the initialization voltage supply line via the initialization switching element. When the holding voltage of the holding capacitor is to be initialized with a connection configuration such as that described above, the write control switching element and the first light emission control switching element are controlled to an off state, and the threshold compensation switching element, the second light emission control switching element, and the initialization switching element are controlled to an on state. Thus, during the period for initialization, no current flows to the drive transistor, and the voltage of the initialization voltage supply line, i.e., the initialization voltage is applied to the holding capacitor via the initialization switching element, the second light emission control switching element, and the threshold compensation switching element. With this configuration, the initialization switching element, the second light emission control switching element, and the threshold compensation switching element form a path for initializing the holding voltage of the holding capacitor, eliminating the need for an initialization switching element provided between the holding capacitor and the initialization voltage supply line for initialization as in a known pixel circuit. As a result, the pixel circuit can be realized with a smaller area than in the related art, and a voltage drop at the control terminal of the drive transistor due to leakage current through the switching element in an off state can be suppressed in the light emission period after writing the data voltage. Thus, according to the several embodiments of the disclosure, it is possible to provide a pixel circuit with a smaller area than in the related art, that has a threshold compensation function and in which no bright dot defect (a bright dot not included in the intended display content) occurs due to leakage current.

BRIEF DESCRIPTION OF DRAWINGS

FIG. 6(A) illustrates a reset operation of the pixel circuit according to the first embodiment, FIG. 6(B) illustrates a data write operation of the pixel circuit, and FIG. 6(C) illustrates a lighting operation of the pixel circuit.

FIG. 11(A) illustrates a reset operation of the pixel circuit according to the second embodiment, FIG. 11(B) illustrates a data write operation of the pixel circuit, and FIG. 11(C) illustrates a lighting operation of the pixel circuit.

DESCRIPTION OF EMBODIMENTS

In the following, each embodiment will be described with reference to the accompanying drawings. Note that in each of the transistors referred to below, the gate terminal corresponds to a control terminal, one of the drain terminal and the source terminal corresponds to a first conduction terminal, and the other corresponds to a second conduction terminal. All the transistors in each embodiment are described as P-channel transistors, but the disclosure is not limited thereto. Furthermore, the transistor in each embodiment is, for example, a thin film transistor, but the disclosure is not limited thereto. Still further, the term "connection" used herein means "electrical connection" unless otherwise specified, and without departing from the spirit and scope of the disclosure, the term includes not only a case in which direct connection is meant but also a case in which indirect connection with another element therebetween is meant.

1. First Embodiment

1.1 Overall Configuration

Figure 1:
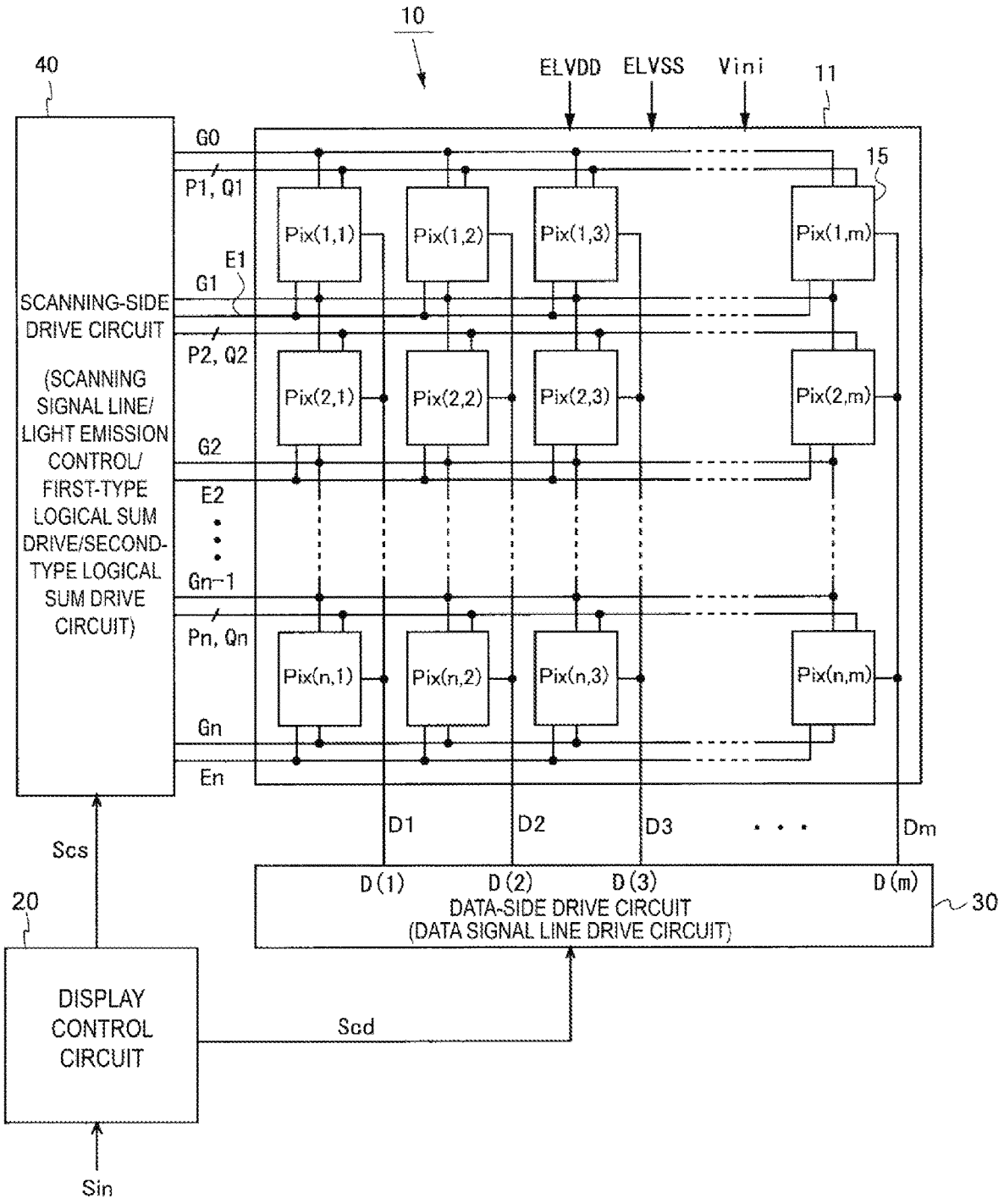
FIG. 1 is a block diagram illustrating an overall configuration of a display device according to a first embodiment.

FIG. 1 is a block diagram illustrating an overall configuration of an organic EL display device 10 according to a first embodiment. The display device 10 is an organic EL display device that performs internal compensation. That is, when pixel data is written to each pixel circuit in the display device 10, a holding capacitor is charged with voltage of a data signal (data voltage) via a drive transistor in a diode-connected state in each pixel circuit to compensate for variations and fluctuations in the threshold voltage of the drive transistor (details described later).

As illustrated in FIG. 1, the display device 10 includes a display portion 11, a display control circuit 20, a data-side drive circuit 30, and a scanning-side drive circuit 40. The data-side drive circuit 30 functions as a data signal line drive circuit (also referred to as a "data driver"). The scanning-side drive circuit 40 functions as a scanning signal line drive circuit (also referred to as a "gate driver"), a light emission control circuit (also referred to as an "emission driver"), a first-type logical sum drive circuit, and a second-type logical sum drive circuit. The four drive circuits are configured as one scanning-side drive circuit 40 in the configuration illustrated in FIG. 1, but a configuration where the four drive circuits are separated as needed in the scanning-side drive circuit 40, or a configuration where the four drive circuits are separated into two scanning-side drive circuits and disposed on different sides of the display portion 11 may be adopted. Additionally, the scanning-side drive circuit may be integrally formed with the display portion 11. The same applies to subsequent embodiments and modification examples.

The display portion 11 is provided with m (m is an integer of 2 or more) data signal lines D1 to Dm, n+1 (n is an integer of 2 or more) scanning signal lines G0 to Gn that intersect the data signal lines D1 to Dm, and n light emission control lines (also referred to as "emission lines") E1 to En disposed along the n scanning signal lines G1 to Gn, respectively. The display portion 11 is also provided with n first-type logical sum signal lines P1 to Pn disposed along the n scanning signal lines G1 to Gn, respectively, and n second-type logical sum signal lines Q1 to Qn disposed along the n scanning signal lines G1 to Gn, respectively (details on the first-type and second-type logical sum signal lines will be described later). As illustrated in FIG. 1, the display portion 11 is provided with m×n pixel circuits 15. The m×n pixel circuits 15 are arranged in a matrix along the m data signal lines D1 to Dm and the n scanning signal lines G1 to Gn. Each pixel circuit 15 corresponds to any one of the m data signal lines D1 to Dm and to any one of the n scanning signal lines G1 to Gn (hereinafter, when distinguishing between each pixel circuit 15, a pixel circuit corresponding to an ith scanning signal line Gi and a jth data signal line Dj will also be referred to as an "ith row, jth column pixel circuit", and will be denoted by the reference sign "Pix(i, j)"). The n light emission control lines E1 to En correspond to the n scanning signal lines G1 to Gn, respectively, the n first-type logical sum signal lines P1 to Pn also correspond to the n scanning signal lines G1 to Gn, respectively, and the n second-type logical sum signal lines Q1 to Qn also correspond to the n scanning signal lines G1 to Gn, respectively. Accordingly, each pixel circuit 15 corresponds to any one of the n light emission control lines E1 to En, any one of the n first-type logical sum signal lines P1 to Pn, and any one of the n second-type logical sum signal lines Q1 to Qn.

The display portion 11 is also provided with a power source line (not illustrated) common to each pixel circuit 15. In other words, a power source line (hereinafter, referred to as a "high-level power source line" and designated by the reference sign "ELVDD" similar to the high-level power supply voltage) used for supplying the high-level power supply voltage ELVDD for driving the organic EL element described later, and a power source line (hereinafter, referred to as a "low-level power source line" and designated by the reference sign "ELVSS" similar to the low-level power supply voltage) used for supplying the low-level power supply voltage ELVSS for driving the organic EL element are provided. The display portion 11 also includes an initialization voltage supply line (not illustrated and denoted by the reference sign "Vini" similar to the initialization voltage) used for supplying an initialization voltage Vini used in a reset operation for initializing each pixel circuit 15 (details described later). The high-level power supply voltage ELVDD, the low-level power supply voltage ELVSS, and the initialization voltage Vini are supplied from a power source circuit (not illustrated).

The display control circuit 20 receives an input signal Sin including image information representing an image to be display and timing control information for image display from outside of the display device 10 and, based on the input signal Sin, generates a data-side control signal Scd and a scanning-side control signal Scs, and outputs the data-side control signal Scd to the data-side drive circuit (data signal line drive circuit) 30 and outputs the scanning-side control signal Scs to the scanning-side drive circuit (scanning signal line drive/light emission control/first-type logical sum drive/second-type logical sum drive circuit) 40.

The data-side drive circuit 30 drives the data signal lines D1 to Dm based on the data-side control signal Scd output from the display control circuit 20. More specifically, the data-side drive circuit 30 outputs in parallel m data signals D(1) to D(m) representing an image to be displayed, and applies the data signals D(1) to D(m) to the data signal lines D1 to Dm, respectively, based on the data-side control signal Scd.

Based on the scanning-side control signal Scs output from the display control circuit 20, the scanning-side drive circuit 40 functions as a scanning signal line drive circuit that drives the scanning signal lines G0 to Gn, a light emission control circuit that drives the light emission control lines E1 to En, a first-type logical sum drive circuit that drives the first-type logical sum signal lines P1 to Pn, and a second-type logical sum drive circuit that drives the second-type logical sum signal lines Q1 to Qn. More specifically, when functioning as the scanning signal line drive circuit, the scanning-side drive circuit 40 sequentially selects the scanning signal lines G0 to Gm in individual frame periods based on the scanning-side control signal Scs, and applies an active signal (low-level voltage) to a selected scanning signal line Gk and an inactive signal (high-level voltage) to the unselected scanning signal lines. With this, m pixel circuits Pix(k, 1) to Pix(k, m) corresponding to the selected scanning signal line Gk ($1 \leq k \leq n$) are collectively selected. As a result, in the select period of the scanning signal line Gk (hereinafter referred to as a "kth scanning select period"), the voltages of the m data signals D(1) to D(m) applied to the data signal lines D1 to Dm from the data-side drive circuit 30 (hereinafter also referred to as simply "data voltages" when not distinguished from each other) are written as pixel data to the pixel circuits Pix(k, 1) to Pix(k, m), respectively.

When functioning as the light emission control circuit, based on the scanning side control signal Scs, the scanning-side drive circuit 40 applies a light emission control signal (high-level voltage) indicating non-light emission to an ith light emission control line Ei in an i-1th horizontal period and an ith horizontal period, and applies a light emission control signal (low-level voltage) indicating light emission to the ith light emission control line Ei in other periods. Organic EL elements in pixel circuits (hereinafter also referred to as "ith row pixel circuits") Pix(i, 1) to Pix(i, m) corresponding to the ith scanning signal line Gi emit light at luminance corresponding to the data voltages written to the ith row pixel circuits Pix(i, 1) to Pix(i, m), respectively, while the voltage of the light emission control line Ei is at a low level.

When functioning as the first-type logical sum drive circuit, based on the scanning-side control signal Scs, the scanning-side drive circuit 40 is configured to apply a signal of a logical sum (hereinafter referred to as "ith first-type logical sum signal P(i)") of a scanning signal of an ith scanning signal line Gi (also referred to as "ith scanning signal G(i)") and a scanning signal of a scanning signal line Gi-1 immediately before the ith scanning signal line Gi (also referred to as "i-1th scanning signal G(i-1)") to an ith first-type logical sum signal line Pi. In the present embodiment, because the scanning signal is a negative logical signal, the ith first-type logical sum signal P(i) is at the low level when either the i-1th scanning signal G(i-1) or the ith scanning signal G(i) is at the low level. Note that, in the following, an ith first-type logical sum signal line may be denoted by the reference sign "Gi-1 ∪ Gi" instead of the reference sign "Pi".

When functioning as the second-type logical sum drive circuit, based on the scanning-side control signal Scs, the scanning-side drive circuit 40 is configured to apply a signal of a logical sum (hereinafter referred to as "ith second-type logical sum signal Q(i)") of the i-1th scanning signal Gi(i-1) and a light emission control signal of the ith light emission control line Ei (also referred to as "ith light emission control signal E(i)") to an ith second-type logical sum signal line Qi. In the present embodiment, because the scanning signal and the light emission control signal are negative logical signals, the ith second-type logical sum signal Q(i) is at the low level when either the i-1th scanning signal G(i-1) or the ith light emission control signal E(i-1) is at the low level. Note that, in the following, an ith second-type logical sum signal line may be denoted by the reference sign "Gi-1 ∪ Ei" instead of the reference sign "Qi".

1.2 Configuration and Operation of Pixel Circuit in Known Example

Prior to describing the configuration and operation of the pixel circuit 15 in the present embodiment, the configuration and operation of a pixel circuit 15*a* in a known organic EL display device (hereinafter referred to as a "known example") as a pixel circuit for comparison with the pixel circuit 15 will be described with reference to FIGS. 2 and 3. In the known example, unlike the configuration illustrated in FIG. 1, the display portion 11 does not include any of the first-type logical sum signal lines P1 to Pn and the second-type logical sum signal lines Q1 to Qn, and the scanning-side drive circuit does not have the functions of the first-type and second-type logical sum drive circuits. Other components in the overall configuration of the known example are the same as the configuration illustrated in FIG. 1.

Figure 2:
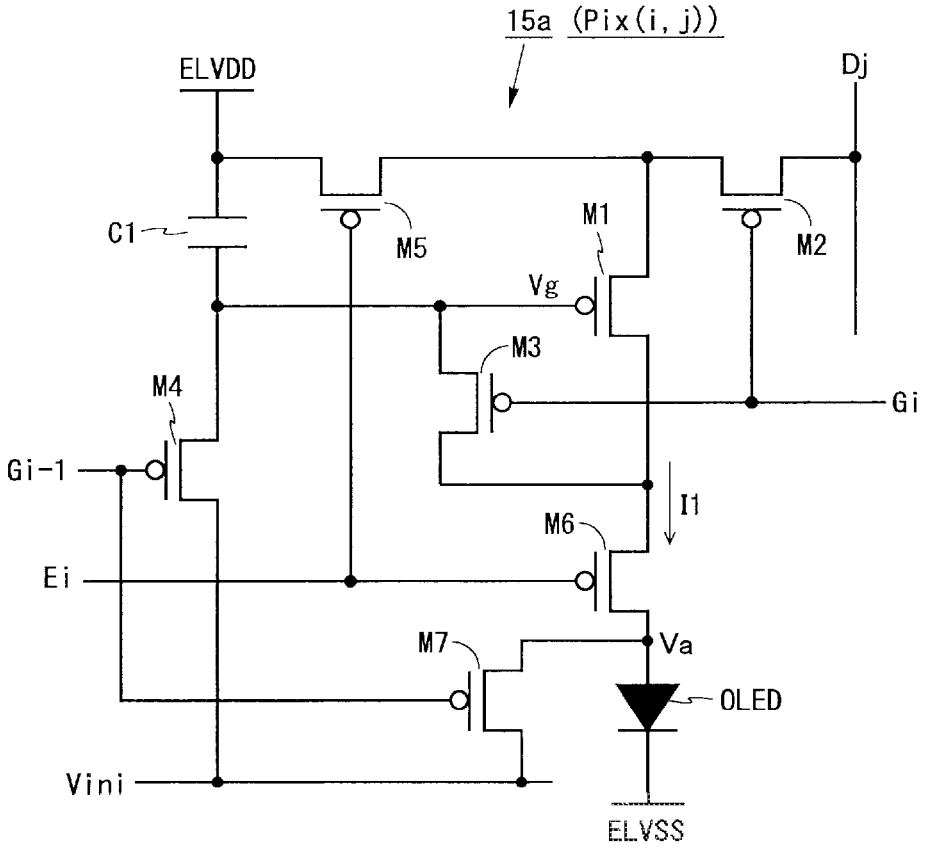
FIG. 2 is a circuit diagram illustrating a configuration of a pixel circuit in a known display device.

FIG. 2 is a circuit diagram illustrating a configuration of the pixel circuit 15*a* in the known example, and more specifically, a pixel circuit 15*a* corresponding to the ith scanning signal line Gi and the jth data signal line Dj, i.e., a pixel circuit representing the configuration of the ith row, jth column pixel circuit Pix(i, j) ($1 \leq i \leq n$, $1 \leq j \leq m$). As illustrated in FIG. 2, the pixel circuit 15*a* includes an organic EL element OLED as a display element, a drive transistor M1, a write control transistor M2, a threshold compensation transistor M3, a first initialization transistor M4, a first light emission control transistor M5, a second light emission control transistor M6, a second initialization transistor M7, and a holding capacitor C1. In the pixel circuit 15*a*, the transistors M2 to M7 other than the drive transistor M1 function as switching elements.

In the pixel circuit 15*a*, a scanning signal line corresponding to the pixel circuit 15*a* (hereinafter also referred to as a "corresponding scanning signal line" in the description focusing on the pixel circuit) Gi, a scanning signal line immediately before the corresponding scanning signal line G1 (a scanning signal line immediately before the scanning signal lines G1 to Gn in scanning order, hereinafter also referred to as a "preceding scanning signal line" in the description focusing on the pixel circuit) Gi-1, a light emission control line corresponding to the preceding scanning signal line (hereinafter also referred to as a "corresponding light emission control line" in the description focusing on the pixel circuit) Ei, a data signal line corresponding to the corresponding light emission control line Ei (hereinafter also referred to as a "corresponding data signal line" in the description focusing on the pixel circuit) Dj, the initialization voltage supply line Vini, the high-level power source line ELVDD, and the low-level power source line ELVSS are connected to each other.

As illustrated in FIG. 2, in the pixel circuit 15*a*, a source terminal of the drive transistor M1 serving as a first conduction terminal is connected to the corresponding data signal line Dj via the write control transistor M2 and to the high-level power source line ELVDD via the first light emission control transistor M5. A drain terminal of the drive transistor M1 serving as a second conduction terminal is connected to an anode electrode of the organic EL element OLED via the second light emission control transistor M6. A gate terminal of the drive transistor M1 is connected to the high-level power source line ELVDD via the holding capacitor C1, the drain terminal of the drive transistor M1 via the threshold compensation transistor M3, and the initialization voltage supply line Vini via the first initialization transistor M4. The anode electrode of the organic EL element OLED is connected to the initialization voltage supply line Vini via the second initialization transistor M7, and a cathode electrode of the organic EL element OLED is connected to the low-level power source line ELVSS. Gate terminals of the write control transistor M2 and the threshold compensation transistor M3 are connected to the corresponding scanning signal line Gi. Gate terminals of the first and second light emission control transistors M5 and M6 are connected to the corresponding light emission control line Ei. Gate terminals of the first and second initialization transistors M4 and M7 are connected to the preceding scanning signal line Gi-1.

The drive transistor M1 operates in a saturation region. A drive current I1 flowing through the organic EL element OLED in the light emission period is given by Equation (1) below. A gain β of the drive transistor M1 included in Equation (1) is given by Equation (2) below.

$$I1 = (\beta/2)(|Vgs| - |Vth|)^2 = (\beta/2)(|Vg - ELVDD| - |Vth|)^2 \quad (1)$$

$$\beta = \mu \times (W/L) \times Cox \quad (2)$$

In Equations (1) and (2), Vth, μ, W, L, and Cox represent the threshold voltage, mobility, gate width, gate length, and gate insulating film capacitance per unit area of the drive transistor M1, respectively.

Figure 3:
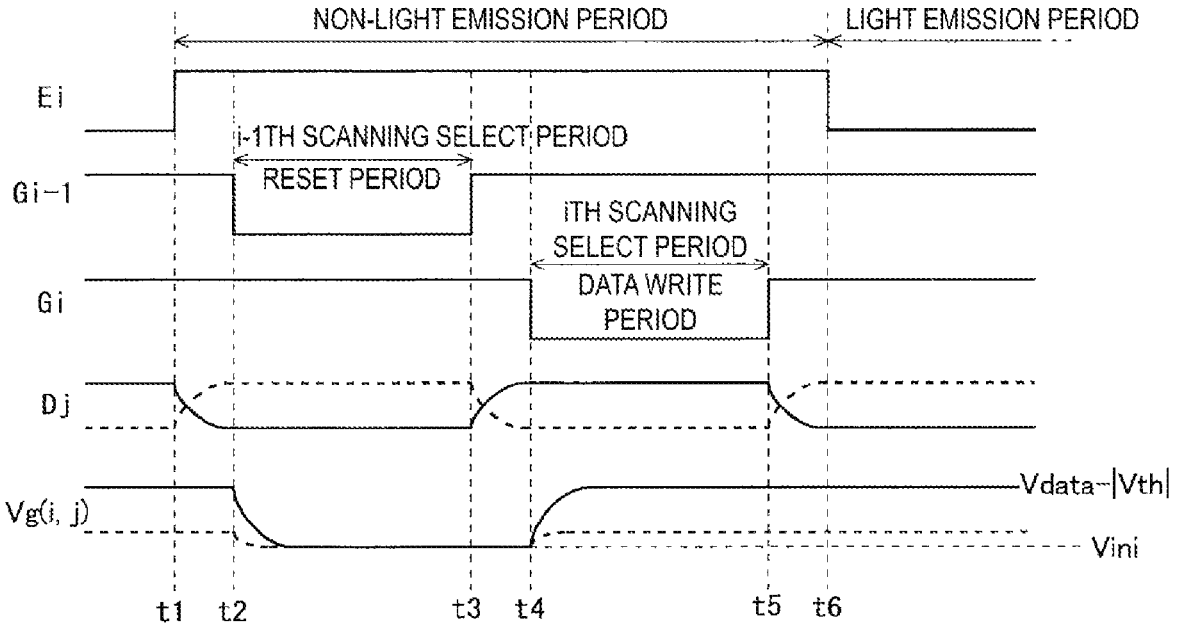
FIG. 3 is a signal waveform diagram for explaining drive of the known display device.

FIG. 3 is a signal waveform diagram for explaining drive of the display device according to the known example, and illustrates fluctuation in the voltages of the signal lines (corresponding light emission control line Ei, preceding scanning signal line Gi-1, corresponding scanning signal line Gi, and corresponding data signal line Dj) in the initialization operation, the reset operation, and the lighting operation of the pixel circuit 15*a* illustrated in FIG. 2, i.e., the ith row, jth column pixel circuit Pix(i, j), and a voltage of the gate terminal of the drive transistor M1 (hereinafter referred to as "gate voltage") Vg. In FIG. 3, the period from the time t1 to the time t6 represents the non-light emission period of the ith row pixel circuits Pix(i, 1) to Pix(i, m). The period from the time t2 to the time t4 is the i-1th horizontal period, and the period from the time t2 to the time t3 is the select period of the i-1th scanning signal line (preceding scanning signal line) Gi-1 (hereinafter referred to as an "i-1th scanning select period"). The i-1th scanning select period corresponds to a reset period of the ith row pixel circuits Pix(i, 1) to Pix (i, m). The period from the time t4 to the time t6 is the ith horizontal period, and the period from the time t4 to the time t5 is the select period of the ith scanning signal line (corresponding scanning signal line) Gi (hereinafter referred to as "ith scanning select period"). The ith scanning select period corresponds to a data write period of the ith row pixel circuits Pix(i, 1) to Pix(i, m).

In the ith row, jth column pixel circuit Pix(i, j), when the voltage of the light emission control line Ei changes from the low level to the high level at the time t1 as illustrated in FIG. 3, the first and second light emission control transistors M5 and M6 change from the on state to the off state, and the organic EL element OLED enters a non-light emission state. During the period from the time t1 to the start time t2 of the i-1th scanning select period, the data-side drive circuit 30 starts to apply the data signal D(j) to the data signal line Dj as the data voltage of the i-1th row, jth column pixel, and, in the pixel circuit Pix(i, j), the write control transistor M2 connected to the data signal line Dj is in an off state.

At the time t2, the voltage of the preceding scanning signal line Gi-1 changes from the high level to the low level, which causes the preceding scanning signal line Gi-1 to enter a select state. Therefore, the first and second initialization transistors M4 and M7 enter the on state. Thus, the voltage of the gate terminal of the drive transistor M1, i.e., the gate voltage Vg is initialized to the initialization voltage Vini. The initialization voltage Vini is such a voltage that the voltage can keep the drive transistor M1 in an on state during the writing of the data voltage to the pixel circuit Pix(i, j). More specifically, the initialization voltage Vini satisfies the following Equation (3).

$$|Vini - Vdata| > |Vth| \quad (3),$$

where Vdata represents the data voltage (voltage of the corresponding data signal line Dj), and Vth represents the threshold voltage of the drive transistor M1. Further, because the drive transistor M1 in the present embodiment is a P-channel transistor, Vini<Vdata . . . (4). By initializing the gate voltage Vg to the initialization voltage Vini in such a way, the data voltage can be reliably written to the pixel circuit Pix(i, j). Note that the initialization of the gate voltage Vg is also the initialization of the holding voltage of the holding capacitor C1. At the time t2, the voltage of the preceding scanning signal line Gi-1 changes from the high level to the low level, which causes the second initialization transistor M7 to change to the on state. As a result, accumulated charge in the parasitic capacitance of the organic EL element OLED is discharged and a voltage (hereinafter referred to as "anode voltage") Va of the anode electrode of the organic EL element is initialized.

The period from the time t2 to the time t3 is a reset period in the ith row pixel circuits Pix(i, 1) to Pix(i, m). In the pixel circuit Pix(i, j), the gate voltage Vg and the anode voltage Va are initialized by the first and second initialization transistors M4 and M7 being in the on state in the reset period as described above. FIG. 3 illustrates a change in a gate voltage Vg(i, j) in the pixel circuit Pix(i, j) at this time. Note that the reference sign "Vg(i, j)" is used to differentiate the gate voltage Vg in the pixel circuit Pix(i, j) from the gate voltage Vg in other pixel circuits (the same applies hereinafter).

At the time t3, the voltage of the preceding scanning signal line Gi-1 changes to the high level, which causes the preceding scanning signal line Gi-1 to enter a non-select state. Therefore, the first and second initialization transistors M4 and M7 enter the off state. During the period from the time t3 to the start time t4 of the ith scanning select period, the data-side drive circuit 30 starts to apply the data signal D(j) to the data signal line Dj as the data voltage of the ith row, jth column pixel, and continues to apply the data signal D(j) until at least the end time t5 of the ith scanning select period.

At the time t4, the voltage of the corresponding scanning signal line Gi changes from the high level to the low level, which causes the corresponding scanning signal line Gi to enter a select state. Because of this, the write control transistor M2 changes to the on state. The threshold compensation transistor M3 also changes to the on state, and hence the drive transistor M1 is in a state in which the gate terminal and the drain terminal of the drive transistor M1 are connected, i.e., in a diode-connected state. As a result, the voltage of the corresponding data signal line Dj, i.e., the voltage of the data signal D(j) is applied to the holding capacitor C1 as the data voltage Vdata via the drive transistor M1 in the diode-connected state. As a result, as illustrated in FIG. 3, the gate voltage Vg(i, j) changes toward the value given by Equation (5) below.

$$Vg(i,j)=V\text{data}-|Vth| \tag{5}$$

The period from the time t4 to the time t5 is a data write period in the ith row pixel circuits Pix(i, 1) to Pix(i, m). In the pixel circuit Pix(i, j), a data voltage that has undergone threshold compensation is written to the holding capacitor C1 in the data write period, and the gate voltage Vg(i, j) is the value given by Equation (5) above.

Then, at the time t6, the voltage of the light emission control line Ei changes to a low level. Accordingly, the first and second light emission control transistors M5 and M6 change to the on state. Thus, after the time t6, the current I1 flows from the high-level power source line ELVDD to the low-level power source line ELVSS via the first light emission control transistor M5, the drive transistor M1, the second light emission control transistor M6, and the organic EL element OLED. This current I1 is given by Equation (1) above. Considering that the drive transistor M1 is a P-channel transistor and ELVDD>Vg, the current I1 is given by Equations (1) and (5) above.

$$\begin{aligned} I1 &= (\beta/2)(ELVDD - Vg - |Vth|)^2 \\ &= (\beta/2)(ELVDD - Vdata)^2 \end{aligned} \tag{6}$$

As described above, after the time t6, the organic EL element OLED emits light at a luminance corresponding to the data voltage Vdata, which is the voltage of the corresponding data signal line Dj in an ith scanning select period, regardless of the threshold voltage Vth of the drive transistor M1.

1.3 Problems in Known Example

As described above, a display device such as that in the known example described above, i.e., a display device employing a pixel circuit configured to write a data voltage to a holding capacitor via a drive transistor in a diode-connected state after initializing the gate voltage of the drive transistor has a problem in that a bright dot defect occurs in the display image. The present inventors studied the operation of the pixel circuit 15*a* in the known example to find the cause of the bright dot defect. Now, the results of this study will be described.

In the pixel circuit 15*a* (Pix(i, j)) in the known example described above, the voltage of the corresponding data signal line Dj is applied to the holding capacitor C1 as the data voltage Vdata via the drive transistor M1 in the diode-connected state, thereby compensating for variation and fluctuation in the threshold voltage Vth of the drive transistor M1. In a pixel circuit employing such an internal compensation method, initialization of the gate voltage Vg of the drive transistor M1, i.e., initialization of the holding voltage of the holding capacitor C1, needs to be performed before the data write operation. Thus, as illustrated in FIG. 2, in the known example described above, the gate terminal of the drive transistor M1 is connected to the initialization voltage supply line Vini via the first initialization transistor M4.

When the pixel circuit 15*a* in the known example is to create a black display, in the data write period, a high voltage near the high-level power supply voltage ELVDD is applied to the gate terminal of the drive transistor M1 as the data voltage Vdata via the drive transistor M1 in the diode-connected state, and, in the light emission period, the gate voltage Vg is maintained at the high voltage by the holding capacitor C1. Thus, in the light emission period, a relatively high voltage (e.g., approximately 8 V) is continuously applied between the source and drain of the first initialization transistor M4 in the off state. As a result, leakage current may occur in the first initialization transistor M4, which may cause the gate voltage Vg to drop. If this occurs, an amount of current that does not correspond to the value of the written data voltage flows to the drive transistor M1 and the organic EL element OLED, and this generates a bright dot (hereinafter referred to as "bright dot defect") not included in the intended display content. A bright dot defect is particularly likely to occur when the off resistance of the first initialization transistor M4 decreases or the threshold voltage (absolute value) of the drive transistor M1 decreases due to manufacturing variation.

Using a transistor with a multi-gate structure, a transistor having a long channel length, or two transistors connected to each other in series as the first initialization transistor M4 has also been considered to minimize the occurrence of a bright dot defect. However, using such transistors increases the size of the first initialization transistor M4 and makes it difficult to achieve compact a pixel circuit.

1.4 Configuration and Operation of Pixel Circuit in Present Embodiment

Figure 4:
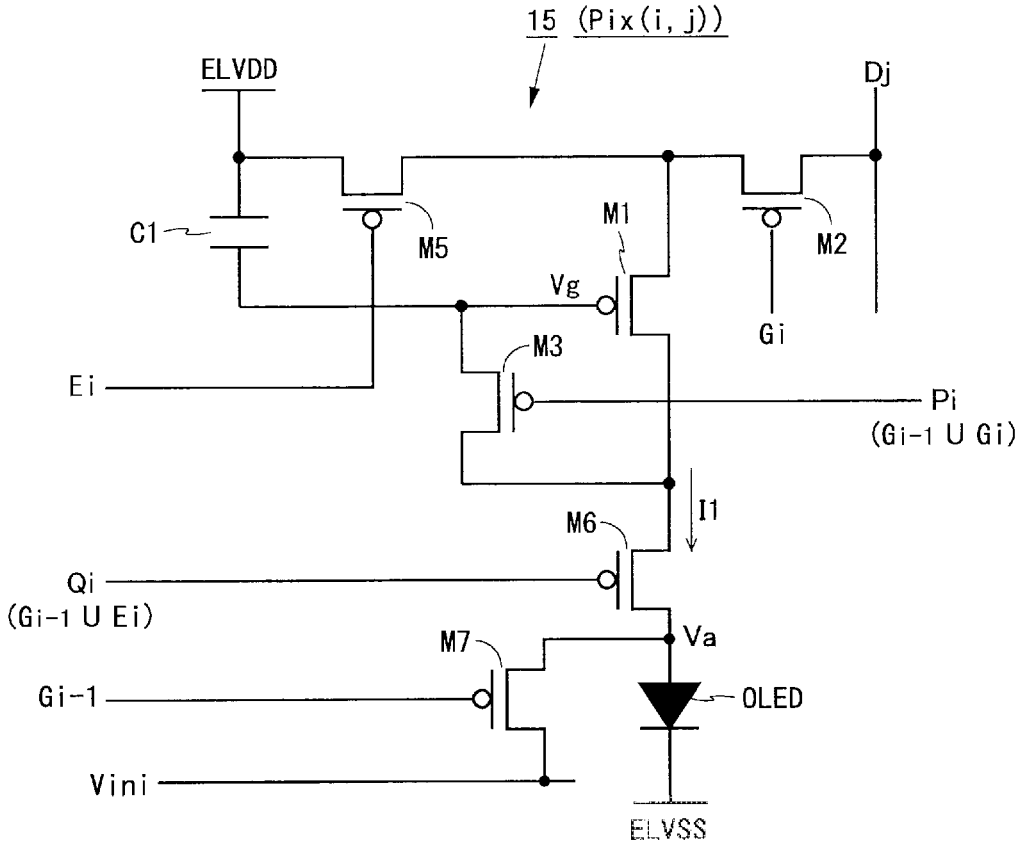
FIG. 4 is a circuit diagram illustrating a configuration of a pixel circuit according to the first embodiment.
Figure 5:
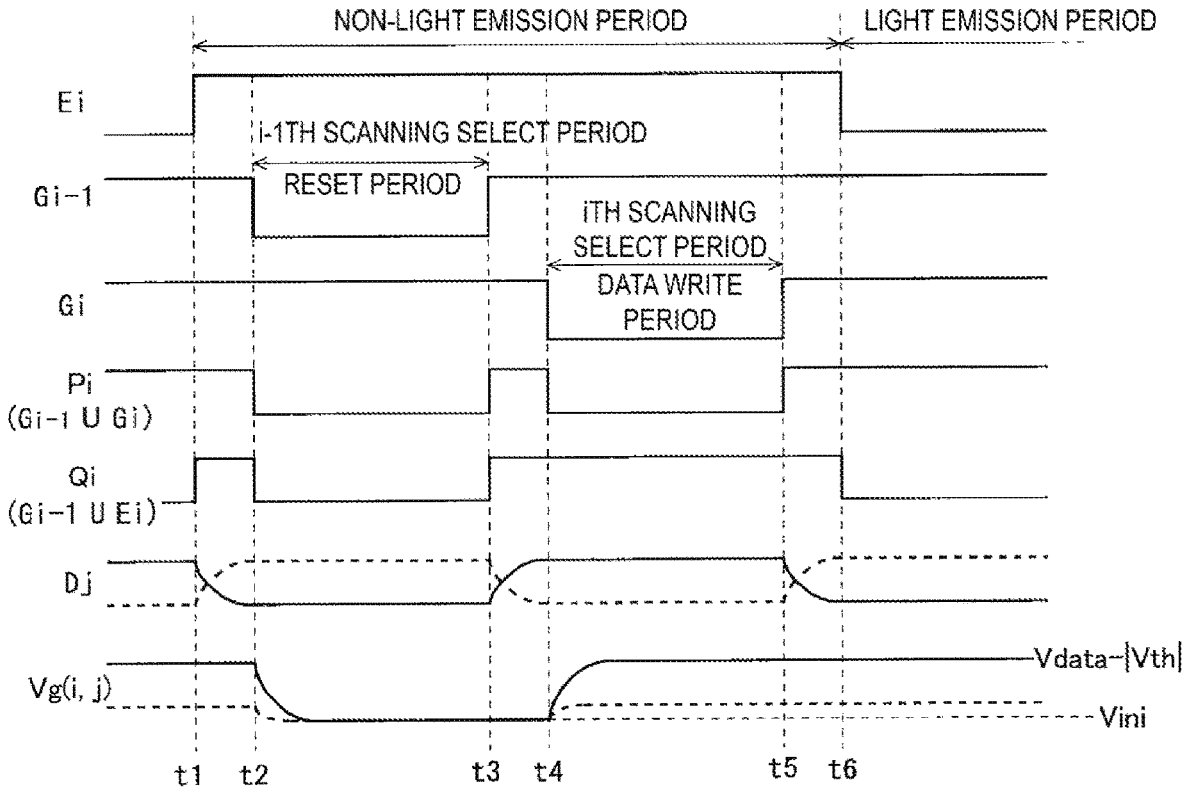
FIG. 5 is a signal waveform diagram for explaining drive of the display device according to the first embodiment.
Figure 6:
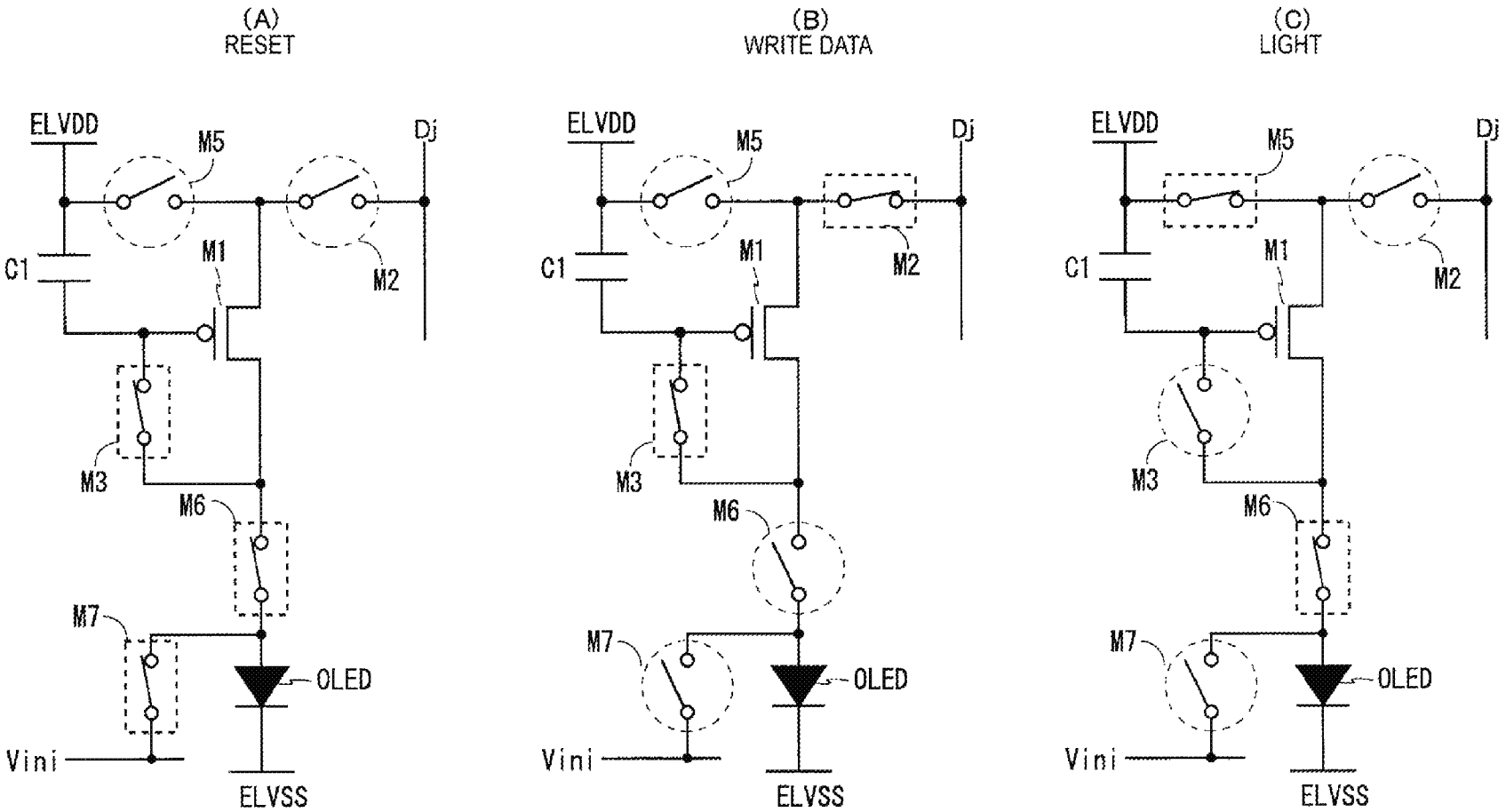
FIGS. 6(A) to 6(C) are circuit diagrams, where

Next, the configuration and operation of the pixel circuit 15 in the present embodiment will be described with reference to FIGS. 4 to 6. FIG. 4 is a circuit diagram illustrating a configuration of the pixel circuit 15 in the present embodiment. FIG. 5 is a signal waveform diagram for explaining drive of the organic EL display device 10 in the present embodiment. FIG. 6(A) is a circuit diagram illustrating a reset operation of the pixel circuit 15 in the present embodiment, FIG. 6(B) is a circuit diagram illustrating a data write operation of the pixel circuit 15, and FIG. 6(C) is a circuit diagram illustrating a lighting operation of the pixel circuit 15.

FIG. 4 illustrates a configuration of a pixel circuit 15 that corresponds to the ith scanning signal line Gi and the jth data signal line Dj in the present embodiment, i.e., an ith row, jth column pixel circuit Pix(i, j) ($1 \le i \le n$, $1 \le j \le m$). Similar to the pixel circuit 15*a* (FIG. 2) in the known example described above, the pixel circuit 15 includes the organic EL element OLED as a display element, the drive transistor M1, the write control transistor M2, the threshold compensation transistor M3, the first light emission control transistor M5, the second light emission control transistor M6, a display element initialization transistor M7, and the holding capacitor C1. However, the pixel circuit 15 does not include the first initialization transistor M4, which is different to the pixel circuit 15*a* in the known example. Note that the display element initialization transistor M7 corresponds to the second initialization transistor M7 in the pixel circuit 15*a* in the known example. As above, in the pixel circuit 15, the transistors M2, M3 and M5 to M7 other than the drive transistor M1 function as switching elements.

As illustrated in FIG. 1, in the pixel circuit 15, a scanning signal line (corresponding scanning signal line) Gi corresponding to the pixel circuit 15, a scanning signal line (preceding scanning signal line) Gi-1 immediately before the corresponding scanning signal line Gi, a light emission control line (corresponding light emission control line) Ei corresponding to the preceding scanning signal line Gi-1, a first-type logical sum signal line (hereinafter referred to as a "corresponding first-type logical sum signal line" in the description focusing on pixel circuits) Pi corresponding to the corresponding light emission control line Ei, a second-type logical sum signal line (hereinafter referred to as a "corresponding second-type logical sum signal line" in the description focusing on pixel circuits) Qi corresponding to the corresponding first-type logical sum signal line Pi, a data signal line (corresponding data signal line) Dj corresponding to the corresponding second-type logical sum signal line Qi, an initialization voltage supply line Vini, a high-level power source line ELVDD, and a low-level power source line ELVSS are connected to each other.

As illustrated in FIG. 4, in the pixel circuit 15, similar to the pixel circuit 15*a* (FIG. 2) in the known example, a source terminal serving as a first conduction terminal of the drive transistor M1 is connected to the corresponding data signal line Dj via the write control transistor M2 and to the high-level power source line ELVDD via the first light emission control transistor M5. A drain terminal serving as a second conduction terminal of the drive transistor M1 is connected to an anode electrode serving as a first terminal of the organic EL element OLED via the second light emission control transistor M6. A gate terminal of the drive transistor M1 is connected to the high-level power source line ELVDD via the holding capacitor C1 and the drain terminal of the drive transistor M1 via the threshold compensation transistor M3. The anode electrode of the organic EL element OLED is connected to the initialization voltage supply line Vini via the display element initialization transistor M7. A cathode electrode of the organic EL element OLED serving as a second terminal is connected to the low-level power source line ELVSS. A gate terminal of the write control transistor M2 is connected to the corresponding scanning signal line Gi. A gate terminal of the first light emission control transistor M5 is connected to the corresponding light emission control line Ei. A gate terminal of the display element initialization transistor M7 is connected to the preceding scanning signal line Gi-1. A gate terminal of the threshold compensation transistor M3 is connected to the corresponding first-type logical sum signal line Pi, and a gate terminal of the second light emission control transistor M6 is connected to the corresponding second-type logical sum signal line Qi. This configuration is different from the pixel circuit 15*a* in the known example. Note that, in the light emission period, the drive current I1 flowing through the organic EL element OLED in the pixel circuit 15*a* is given by Equation (1) above, similar to the pixel circuit 15*a* in the known example.

FIG. 5 illustrates fluctuation in the voltages of signal lines (corresponding light emission control line Ei, preceding scanning signal line Gi-1, corresponding scanning signal line Gi, corresponding first-type logical sum signal line Pi, corresponding second-type logical sum signal line Qi, and corresponding data signal line Dj) in the initialization operation, the reset operation, and the lighting operation of the pixel circuit 15 illustrated in FIG. 4, i.e., the ith row, jth column pixel circuit Pix(i, j), and the gate voltage Vg of the drive transistor M1. In FIG. 5, similar to the known example described above (see FIG. 3), the period from the time t1 to the time t6 is a non-light emission period of the ith row pixel circuits Pix(i, 1) to Pix(i, m). The period from the time t2 to the time t4 is the i-1th horizontal period, and the period from the time t2 to the time t3 is the select period of the i-1th scanning signal line (preceding scanning signal line) Gi-1, i.e., the i-1th scanning select period. The i-1th scanning select period corresponds to a reset period of the ith row pixel circuits Pix(i, 1) to Pix (i, m). The period from the time t4 to the time t6 is the ith horizontal period, and the period from the time t4 to the time t5 is the select period of the ith scanning signal line (corresponding scanning signal line) Gi, i.e., the ith scanning select period. The ith scanning select period corresponds to the data write period of the ith row pixel circuits Pix(i, 1) to Pix(i, m).

Also in the present embodiment, in the ith row, jth column pixel circuit Pix(i, j), when the voltage of the light emission control line Ei changes from the low level to the high level at the time t1 as illustrated in FIG. 5, the first and second light emission control transistors M5 and M6 change from the on state to the off state, and the organic EL element OLED enters a non-light emission state, similar to the known example described above. During the period from the time t1 to the start time t2 of the i-1th scanning select period, the data-side drive circuit 30 starts to apply the data signal D(j) to the data signal line Dj as the data voltage of an i-1th row, jth column pixel. In the pixel circuit Pix(i, j), the write control transistor M2 connected to the data signal line Dj is in an off state.

At the time t2, the voltage of the preceding scanning signal line Gi-1 changes from the high level to the low level, which causes the preceding scanning signal line Gi-1 to enter a select state. Therefore, the display element initialization transistor M7 enters the on state. In the present embodiment, as illustrated in FIG. 5, at the time t2, the voltages of the corresponding first-type logical sum signal line Pi and the corresponding second-type logical sum signal line Qi are also at the low level. Thus, unlike the known example described above, the threshold compensation transistor M3 and the second light emission control transistor M6 are also in the on state.

The period from the time t2 to the time t3 is a reset period in the ith pixel circuits Pix(i, 1) to Pix(i, m). In the reset period, in the pixel circuit Pix(i, j), the display element initialization transistor M7, the second light emission control transistor M6, and the threshold compensation transistor M3 are in the on state as described above. FIG. 6(A) schematically illustrates the state of the pixel circuit Pix(i, j) in the reset period, i.e., the circuit state during the reset operation. In FIG. 6(A), the dotted circles indicate that the transistors serving as switching elements in the pixel circuit are in an off state and the dotted rectangles indicate that the transistors serving as switching elements in the pixel circuit are in an on state (such a representation is also employed in FIGS. 6(B) and 6(C) and FIGS. 11(A) to 11(C) described below). As illustrated in FIG. 6(A), in the reset period, because the display element initialization transistor M7, the second light emission control transistor M6, and the threshold compensation transistor M3 are in the on state, the initialization voltage supply line Vini is electrically connected to the gate terminal of the drive transistor M1 and one terminal of the holding capacitor C1 via these three transistors M7, M6, and M3. In other words, the three transistors M7, M6, and M3*a* form a path (hereinafter referred to as a "reset path") used to apply the initialization voltage Vini to the gate terminal of the drive transistor M1. Thus, during the reset period, the initialization voltage Vini is supplied from the initialization voltage supply line Vini to the gate terminal of the drive transistor M1 due to the reset path. As a result, the gate voltage Vg and the holding voltage of the holding capacitor C1 are initialized in the same manner as in the known example (see Expressions (3) and (4) above). In the reset period, the display element initialization transistor M7 is in the on state, and thus the charge held in the parasitic capacitance of the organic EL element OLED is discharged. As a result, the anode voltage Va is also initialized.

At the time t3, as illustrated in FIG. 5, the voltage of the preceding scanning signal line Gi-1 changes to the high level, which causes the preceding scanning signal line Gi-1 to enter a non-select state. Therefore, the display element initialization transistor M7 enters the off state. At this time, the voltages of the first-type and second-type logical sum signal lines Pi and Qi also change to the high level, and hence the threshold compensation transistor M3 and the second light emission control transistor M6 also enter the off state. During the period from the time t3 to the start time t4 of the ith scanning select period, the data-side drive circuit 30 starts to apply the data signal D(j) to the data signal line Dj as the data voltage of the ith row, jth column pixel, and continues to apply the data signal D(j) until at least the end time t5 of the ith scanning select period.

At the time t4, as illustrated in FIG. 5, the voltage of the corresponding scanning signal line Gi changes from the high level to the low level, which causes the corresponding scanning signal line Gi to enter a select state. Because of this, the write control transistor M2 changes to the on state. At this time, the voltage of the first-type logical sum signal line Pi also changes to the low level, and hence the threshold compensation transistor M3 also enters the on state.

The period from the time t4 to the time t5 is a data write period in the ith pixel circuits Pix(i, 1) to Pix(i, m). In the data write period, the write control transistor M2 and the threshold compensation transistor M3 are in an on state as described above. FIG. 6(B) schematically illustrates the state of the pixel circuit Pix(i, j) in the data write period, i.e., the circuit state during the data write operation. In this data write period, similar to the known example described above, the voltage of the corresponding data signal line Dj is applied to the holding capacitor C1 as the data voltage Vdata via the drive transistor M1 in the diode-connected state. As a result, as illustrated in FIG. 5, the gate voltage Vg(i, j) changes toward the value given in Expression (5) above. That is, in the data write period, a data voltage that has undergone threshold compensation is written to the holding capacitor C1, and the gate voltage Vg(i, j) is the value given by Expression (5) above.

At the time t5, which is the end time of the ith scanning select period as the data write period, the voltage of the corresponding scanning signal line Gi changes to the high level. As a result, the write control transistor M2 enters the off state. At this time, as illustrated in FIG. 5, the voltage of the first-type logical sum signal line Pi also changes to a high level, and hence the threshold compensation transistor M3 also enters the off state.

Then, at the time t6, the voltage of the light emission control line Ei changes to a low level. Because of this, the first light emission control transistor M5 enters the on state. At this time, as illustrated in FIG. 5, the voltage of the second-type logical sum signal line Qi also changes to a low level, and hence the second light emission control transistor M6 also enters the on state. The time after the time t6 is a light emission period. In this light emission period, in the pixel circuit Pix(i, j), the first and second light emission control transistors M5 and M6 are in the on state as described above, and the write control transistor M2, the threshold compensation transistor M3, and the display element initialization transistor M7 are in the off state. FIG. 6(C) schematically illustrates the state of the pixel circuit Pix(i, j) in the light emission period, i.e., the circuit state during the lighting operation. In the light emission period, similar to the known example described above, the current I1 flows from the high-level power source line ELVDD to the low-level power source line ELVSS via the first light emission control transistor M5, the drive transistor M1, the second light emission control transistor M6, and the organic EL element OLED. The current I1 corresponds to the voltage written to the holding capacitor C1 during the data write period (t4 to t5), and threshold compensation is performed simultaneously in the data write period to derive the current I1 by Expression (6). As a result, in the light emission period, similar to the known example described above, the organic EL element OLED emits light at a luminance corresponding to the data voltage Vdata, which is the voltage of the corresponding data signal line Dj in the ith scanning select period, regardless of the threshold voltage Vth of the drive transistor M1.

1.5 Actions and Effects

Figure 7:
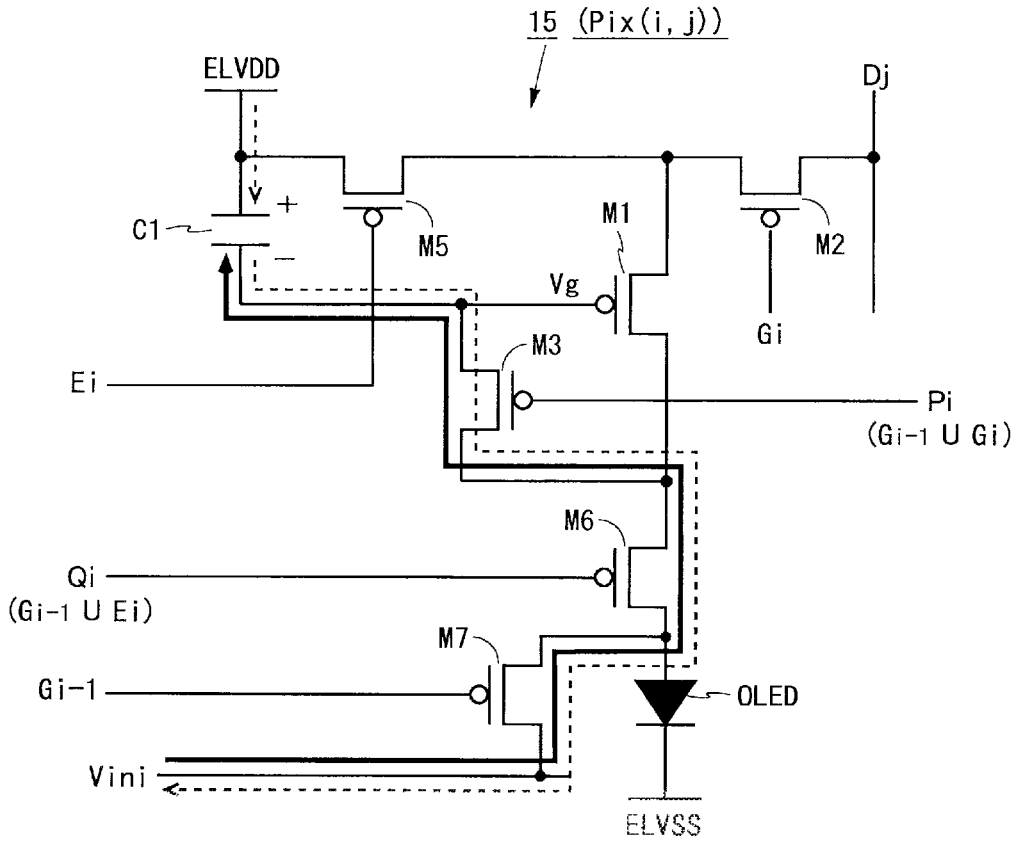
FIG. 7 is a circuit diagram for explaining actions and effects of the first embodiment.

In the present embodiment as described above, similar to the known example, in the pixel circuit Pix(i, j), the voltage of the corresponding data signal line Dj is applied to the holding capacitor C1 as the data voltage Vdata via the drive transistor M1 in the diode-connected state, thereby compensating for variations and fluctuations in the threshold voltage of the drive transistor M1. In order to write data along with this threshold compensation, the gate voltage Vg of the drive transistor M1 needs to be initialized (initialization of the holding voltage of the holding capacitor C1) prior to the data write operation, similar to the known example. In the present embodiment, unlike the known example (FIG. 2), the first initialization transistor M4 used for initializing the gate voltage Vg of the drive transistor M1 is not included in the pixel circuit Pix(i, j). In the reset period, the display element initialization transistor M7, the second light emission control transistor M6, and the threshold compensation transistor M3 are in the on state, and, as illustrated in FIG. 7, these three transistors M7, M6, and M3 form the reset path used for applying the initialization voltage Vini to the gate terminal of the drive transistor M1 (see the thick solid line in FIG. 7). In the present embodiment, because the drive transistor M1 is a P-channel transistor, forming the reset path causes current to flow as indicated by the dotted line in FIG. 7 to charge the holding capacitor C1 and, as a result, the gate voltage Vg is initialized to the initialization voltage Vini.

In the present embodiment, the first-type and second-type logical sum signal lines Pi and Qi are required to drive the pixel circuit 15 (Pix(i, j)) (i=1 to n). Further, the first initialization transistor M4 provided between the gate terminal of the drive transistor M1 and the initialization voltage supply line Vini in the known example described above is removed, and the gate voltage Vg of the drive transistor M1 is initialized by the reset path including the three transistors M7, M6, M3 connected to each other in series. With the pixel circuit 15 having such a configuration, the transistor serving as a switching element connected to the gate terminal of the drive transistor M1 (one terminal of the holding capacitor C1) is only the threshold compensation transistor M3, and the gate terminal is connected to the anode electrode of the organic EL element OLED via the threshold compensation transistor M3 and the second light emission control transistor M6 (see FIG. 4). In the light emission period, the anode voltage Va of the organic EL element OLED is higher than the voltage of the initialization voltage supply line Vini by at least several volts, and the second light emission control transistor M6 is in the on state. Because of this, the voltage applied between the source and drain of the threshold compensation transistor M3 in the off state in the light emission period is a voltage corresponding to the difference between the gate voltage Vg of the drive transistor M1 and the anode voltage Va (see FIG. 6(C)) and is smaller than the voltage (Vg−Vini) applied between the source and drain of the first initialization transistor M4 (see FIG. 2) in the off state in the known example. This sufficiently reduces leakage current of the transistor in the off state that causes a drop in the gate voltage Vg during the light emission period. Thus, it is possible to suppress a drop in the gate voltage Vg due to leakage current from a transistor in the off state in the light emission period with a pixel circuit smaller than in the known example. Thus, with the present embodiment, it is possible to provide a pixel circuit 15 having the same function as the pixel circuit 15*a* in the known example (including the function of threshold compensation) with no bright dot defects due to leakage current as described above and with an area smaller than in the known example.

2. Second Embodiment

In the pixel circuit Pix(i, j) according to the first embodiment, as illustrated in FIG. 4, the gate terminal of the display element initialization transistor M7 is connected to the preceding scanning signal line Gi-1.

Thus, as illustrated in FIG. 5, the display element initialization transistor M7 enters the on state in the i-1 scanning select period as the reset period, which initializes the anode voltage Va of the organic EL display element OLED. However, because the display element initialization transistor M7 may be in the on state in the ith scanning select period as the data writing period, the display element initialization transistor M7 may have a configuration where the gate terminal of the display element initialization transistor M7 is connected to the first-type logical sum signal line Pi instead of the preceding scanning signal line Gi-1. An organic EL display device having such a configuration will be described below as a second embodiment.

Figure 8:
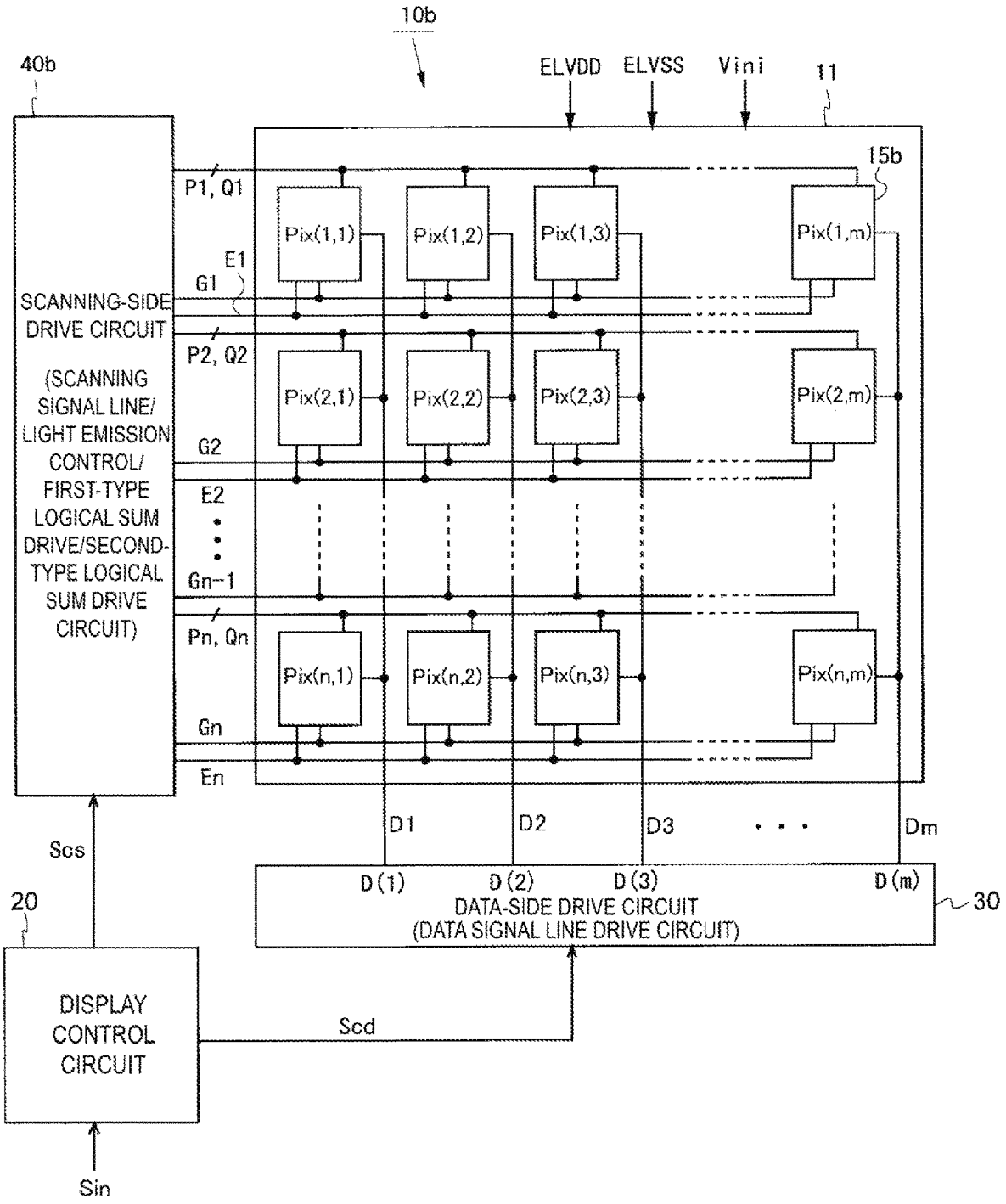
FIG. 8 is a block diagram illustrating an overall configuration of a display device according to a second embodiment.

FIG. 8 is a block diagram illustrating an overall configuration of an organic EL display device 10*b* according to the second embodiment. The display device 10*b* is also an organic EL display device that performs internal compensation. As illustrated in FIG. 8, the display device 10*b* includes a display portion 11*b*, the display control circuit 20, the data-side drive circuit 30, and a scanning-side drive circuit 40*b*.

Similar to the first embodiment (see FIG. 1), the display portion 11*b* includes m data signal lines D1 to Dm, n (n is an integer of 2 or more) scanning signal lines G1 to Gn intersecting the data signal lines D1 to Dm, n light emission control lines E1 to En disposed along the n scanning signal lines G1 to Gn, respectively, n first-type logical sum signal lines P1 to Pn disposed along the n scanning signal lines G1 to Gn, respectively, and n second-type logical sum signal lines Q1 to Qn disposed along the n scanning signal lines G1 to Gn, respectively. The display portion 11*b* is also provided with m×n pixel circuits 15*b*. The m×n pixel circuits 15*b* are arranged in a matrix along the m data signal lines D1 to Dm and the n scanning signal lines G1 to Gn. Each pixel circuit 15*b* corresponds to any one of the m data signal lines D1 to Dm and to any one of the n scanning signal lines G1 to Gn (hereinafter, when distinguishing between each pixel circuit 15*b*, a pixel circuit corresponding to an ith scanning signal line Gi and a jth data signal line Dj will also be referred to as an "ith row, jth column pixel circuit", and will be denoted by the reference sign "Pix(i, j)").

However, the display portion 11*b* of the present embodiment is not provided with a preceding scanning signal line G0, i.e., a 0th scanning signal line G0 for first row pixel circuits Pix(1,1) to Pix(1,*m*). Accordingly, the scanning-side drive circuit 40*b* does not have a function of outputting a scanning signal G(0) to be applied to the 0th scanning signal line G0. A first-type logical sum signal P(1) to be applied to a first first-type logical sum signal line P1 is a signal of a logical sum of a scanning signal G(1) to be applied to a first scanning signal line G1 and the scanning signal G(0) to be applied to the 0th scanning signal line G0. A second-type logical sum signal Q(1) to be applied to a first second-type logical sum signal line Q1 is a signal of a logical sum of the scanning signal G(0) to be applied to the 0th scanning signal line G0 and a light emission control signal E(1) to be applied to a first light emission control line E1. Thus, a signal corresponding to the scanning signal G(0) to be applied to the 0th scanning signal line G0 is used in the scanning-side drive circuit 40*b*.

As illustrated in FIG. 8, in the display portion 11*b* of the present embodiment, each pixel circuit Pix(i, j) is connected to the corresponding scanning signal line Gi but not connected to the preceding scanning signal line Gi-1, which is different from the first embodiment.

Configurations other than those described above in the present embodiment are the same as configurations of the first embodiment, and the same reference signs are assigned to the same or corresponding components and detailed descriptions of those components will be omitted.

Figure 9:
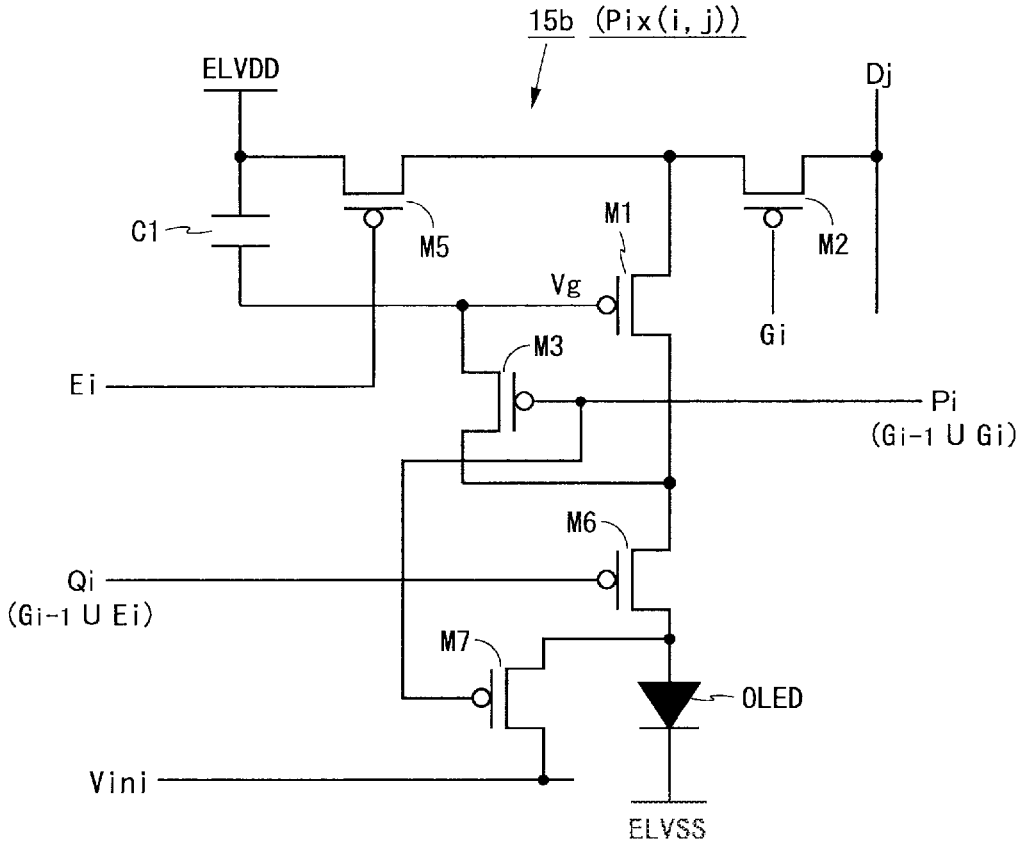
FIG. 9 is a circuit diagram illustrating a configuration of a pixel circuit according to the second embodiment.
Figure 10:
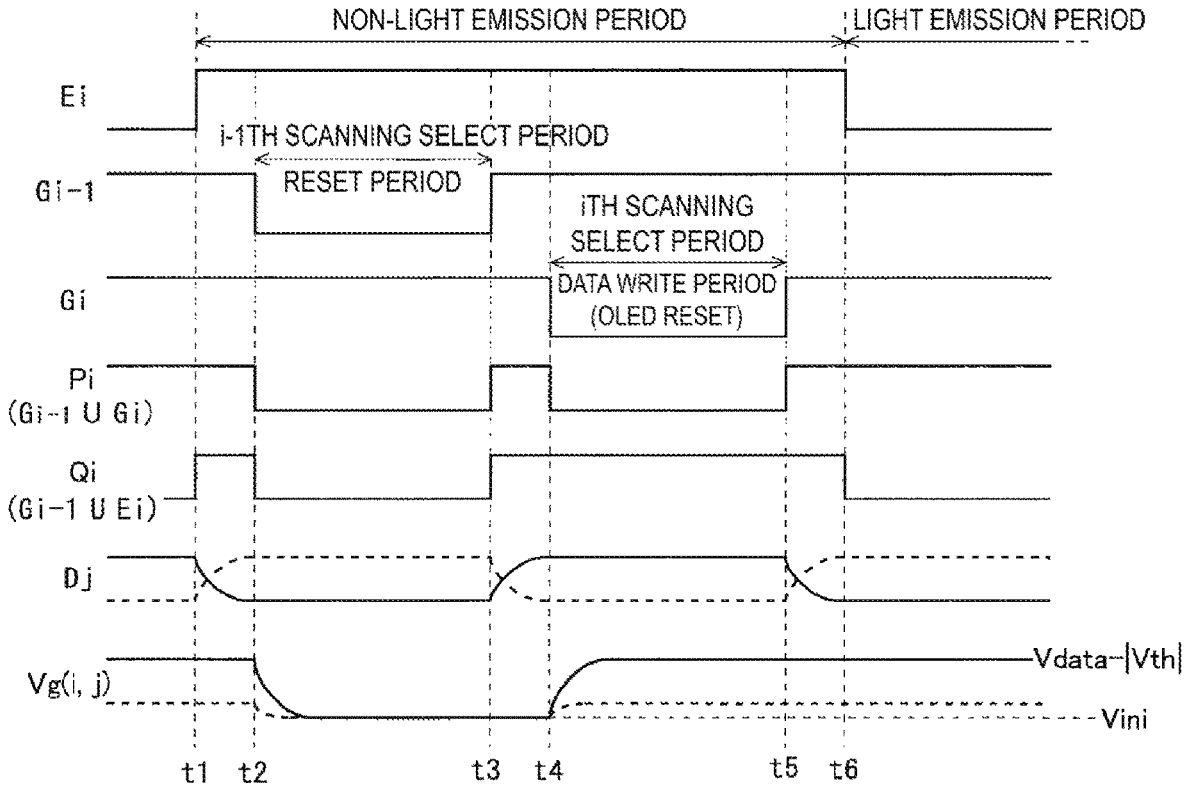
FIG. 10 is a signal waveform diagram for explaining drive of the display device according to the second embodiment.
Figure 11:
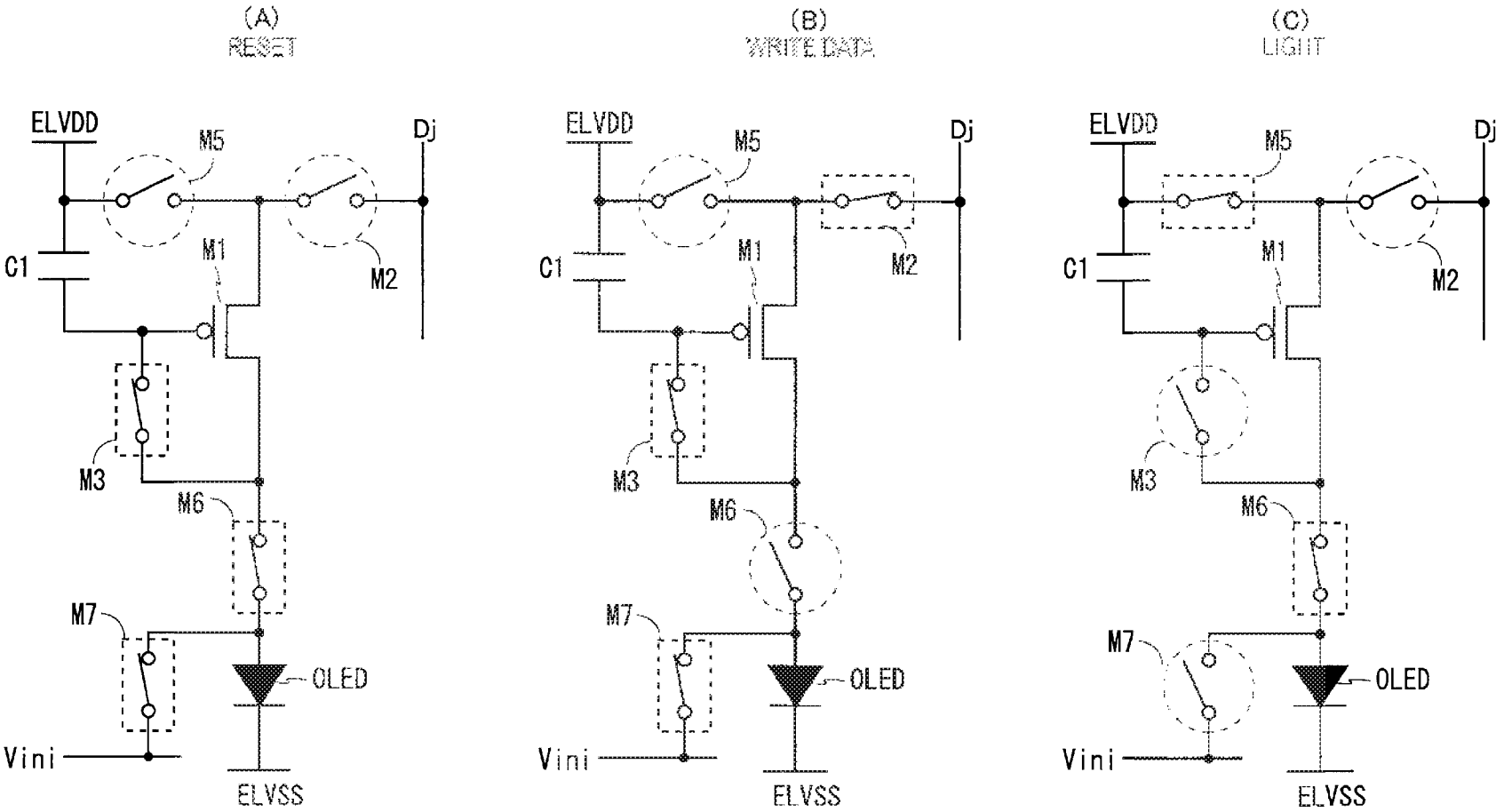
FIGS. 11(A) to 11(C) are circuit diagrams, where

Now, the configuration and operation of the present embodiment will be described below with reference to FIGS. 8, 9, 10, and 11, primarily focusing on differences to the first embodiment. FIG. 9 is a circuit diagram illustrating a configuration of the pixel circuit 15*b* in the present embodiment. FIG. 10 is a signal waveform diagram for explaining drive of the organic EL display device 10*b* according to the present embodiment. FIG. 11(A) is a circuit diagram illustrating a reset operation of the pixel circuit 15*b* in the present embodiment, FIG. 11(B) is a circuit diagram illustrating a data write operation of the pixel circuit 15*b*, and FIG. 11(C) is a circuit diagram illustrating a lighting operation of the pixel circuit 15*b*.

FIG. 9 illustrates the configuration of a pixel circuit 15*b* corresponding to the ith scanning signal line Gi and the jth data signal line Dj in the present embodiment, i.e., the configuration of an ith row, jth column pixel circuit Pix(i, j) ($1 \le i \le n$, $1 \le j \le m$). Similar to the pixel circuit 15 (FIG. 4) in the first embodiment described above, the pixel circuit 15*b* includes the organic EL element OLED as a display element, the drive transistor M1, the write control transistor M2, the threshold compensation transistor M3, the first light emission control transistor M5, the second light emission control transistor M6, the display element initialization transistor M7, and the holding capacitor C1. As illustrated in FIG. 9, in the pixel circuit 15*b*, the gate terminal of the display element initialization transistor M7 is connected to the first-type logical sum signal line Pi, and in this regard, the pixel circuit 15*b* is different from the pixel circuit 15 in the first embodiment in which the gate terminal of the display element initialization transistor M7 is connected to the preceding scanning signal line Gi-1. Other portions of the connection configuration in the pixel circuit 15*b* are the same as the pixel circuit 15 in the first embodiment (see FIG. 4).

FIG. 10 illustrates fluctuation in the voltages of signal lines (corresponding light emission control line Ei, preceding scanning signal line Gi-1, corresponding scanning signal line Gi, corresponding first-type logical sum signal line Pi, corresponding second-type logical sum signal line Qi, and corresponding data signal line Dj) in the initialization operation, the reset operation, and the lighting operation of the pixel circuit 15*b* illustrated in FIG. 9, i.e., the ith row, jth column pixel circuit Pix(i, j), and the gate voltage Vg of the drive transistor M1. The voltage change of these signal lines is the same as the voltage change of the corresponding signal lines in the first embodiment (FIG. 5), but in the ith row, jth column pixel circuit Pix(i, j), the voltage of the preceding scanning signal line Gi-1, i.e., the scanning signal G(i-1) is not used.

The period from the time t2 to the time t3 illustrated in FIG. 10 is the reset period of the pixel circuit Pix(i, j). FIG. 11(A) schematically illustrates the state of the pixel circuit Pix(i, j) in the reset period, i.e., the circuit state during the reset operation. As illustrated in FIG. 11(A), the reset operation in the present embodiment is the same as the reset operation in the first embodiment (FIG. 6(A)). Thus, in the reset period, the display element initialization transistor M7, the second light emission control transistor M6, and the threshold compensation transistor M3 connected to each other in series enter the on state and form the reset path. This reset path causes the initialization voltage Vini to be supplied from the initialization voltage supply line Vini to the gate terminal of the drive transistor M1. Similar to the first embodiment, in the reset period, the display element initialization transistor M7 is in the on state, and thus the accumulated charge in the parasitic capacitance of the organic EL element OLED is discharged and the anode voltage Va is initialized.

The period from the time t4 to the time t5 illustrated in FIG. 10 is the data write period of the pixel circuit Pix(i, j). FIG. 11(B) schematically illustrates the state of the pixel circuit Pix(i, j) in the data write period, i.e., the circuit state during the data write operation. As illustrated in FIG. 11(B), in the data write operation in the present embodiment, the display element initialization transistor M7 is in the on state, which is different from the data write operation in the first embodiment (FIG. 6(B)) in which the display element initialization transistor M7 is in the off state. However, other aspects are similar to the data write operation in the first embodiment described above. That is, the voltage of the corresponding data signal line Dj is also applied to the holding capacitor C1 as the data voltage Vdata via the drive transistor M1 in the diode-connected state in the present embodiment.

The time t6 onward illustrated in FIG. 10 is the light emission period of the pixel circuit Pix(i, j). FIG. 11(C) schematically illustrates the state of the pixel circuit Pix(i, j) in the light emission period, i.e., the circuit state during the lighting operation. As illustrated in FIG. 11(C), the lighting operation in the present embodiment is the same as the lighting operation in the first embodiment (FIG. 6(C)). Accordingly, in the light emission period, similar to the first embodiment described above, the current I1 flows from the high-level power source line ELVDD to the low-level power source line ELVSS via the first light emission control transistor M5, the drive transistor M1, the second light emission control transistor M6, and the organic EL element OLED. The current I1 corresponds to the voltage written to the holding capacitor C1 during the data write period (t4 to t5), and threshold compensation is performed simultaneously in the data write period to derive the current I1 by Expression (6). As a result, in the light emission period, similar to the first embodiment described above, the organic EL element OLED emits light at a luminance corresponding to the data voltage Vdata, which is the voltage of the corresponding data signal line Dj in the ith scanning select period, regardless of the threshold voltage Vth of the drive transistor M1.

As above, in the present embodiment, the initialization operation of the anode voltage Va of the organic EL element OLED is slightly different (see FIG. 11(B)), but the pixel circuit Pix(i, j) operates substantially in the same way as in the first embodiment. More specifically, in the reset period, the gate voltage Vg of the drive transistor M1 is initialized by the reset path in which the three transistors M7, M6, M3 are connected in series, and the first initialization transistor M4 provided between the gate terminal of the drive transistor M1 and the initialization voltage supply line Vini for initializing the gate voltage Vg in the known example is removed. Thus, even with the present embodiment it is possible to provide a pixel circuit 15 having the same function as the pixel circuit 15*a* in the known example (including the function of threshold compensation) with no bright dot defects due to leakage current as described above and with an area smaller than in the known example.

In the present embodiment, unlike the first embodiment, the display portion 11*b* does not include the 0th scanning signal line G0, and the preceding scanning signal line Gi-1 is not connected to each of the pixel circuits Pix(i, j) (see FIGS. 8 and 9). Therefore, with the present embodiment, the area required for disposing signal lines in the display portion 11*b* can made smaller than in the known example and the first embodiment described above.

3. Modification Examples

The disclosure is not limited to the embodiments described above, and various modifications may be made without departing from the scope of the disclosure.

In the above description, an organic EL display device has been described as an example and embodiments and modification examples thereof have been given. However, the disclosure is not limited to an organic EL display device and may be applied to any display device employing an internal compensation method using a display element driven by a current. The display element that can be used in such a configuration is a display element in which luminance, transmittance, or other factors are controlled by a current and includes, for example, an organic EL element, i.e., an organic light-emitting diode (OLED), or an inorganic light-emitting diode or a quantum dot light-emitting diode (QLED).

REFERENCE SIGNS LIST

10, 10*b* Organic EL display device
11, 11*b* Display portion
15, 15*b* Pixel circuit
Pix(i, j) Pixel circuit (i=1 to n, j=1 to m)
20, 20*b* Display control circuit
30 Data-side drive circuit (data signal line drive circuit)
40, 40*b* Scanning-side drive circuit (scanning signal line/light emission control/first-type logical sum drive/second-type logical sum drive circuit)
Gi Scanning signal line (i=1 to n)
Ei Light emission control line (i=1 to n)
Pi First-type logical sum signal line (i=1 to n)
Qi Second-type logical sum signal line (i=1 to n)
Dj Data signal line (j=1 to m)
Vini Initialization voltage supply line, initialization voltage
ELVDD High-level power source line (first power source line), high-level power supply voltage
ELVSS Low-level power source line (second power source line), low-level power supply voltage
OLED Organic EL element C1 Holding capacitor
M1 Drive transistor
M2 Write control transistor (write control switching element)
M3 Threshold compensation transistor (threshold compensation switching element)
M4 First initialization transistor
M5 First light emission control transistor (first light emission control switching element)
M6 Second light emission control transistor (first light emission control switching element)
M7 Display element initialization transistor (initialization switching element)

The invention claimed is:

1. A display device including a plurality of data signal lines, a plurality of scanning signal lines intersecting the plurality of data signal lines, a plurality of light emission control lines individually corresponding to the plurality of scanning signal lines, and a plurality of pixel circuits arranged in a matrix along the plurality of data signal lines and the plurality of scanning signal lines, the display device comprising:

first and second power source lines;

an initialization voltage supply line;

a data signal line drive circuit configured to drive the plurality of data signal lines;

a scanning signal line drive circuit configured to selectively drive the plurality of scanning signal lines; and a light emission control circuit configured to drive the plurality of light emission control lines, each pixel circuit comprising:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and an initialization switching element, wherein a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, and the second conduction terminal via the threshold compensation switching element, the first terminal of the display element is connected to the initialization voltage supply line via the initialization switching element, and a second terminal of the display element is connected to the second power source line, and when a holding voltage of the holding capacitor is to be initialized, the threshold compensation switching element, the second light emission control switching element, and the initialization switching element are controlled to an on state, and the write control switching element and the first light emission control switching element are controlled to an off state.

2. The display device according to claim 1, wherein, when writing a voltage of any one of the plurality of data signal lines to the holding capacitor as a data voltage, the write control switching element and the threshold compensation switching element are controlled to an on state, and the first light emission control switching element and the second light emission control switching element are controlled to an off state.

3. The display device according to claim 2, wherein, when the display element is to be driven based on the holding voltage of the holding capacitor, the first light emission control switching element and the second light emission control switching element are controlled to an on state, and the write control switching element, the threshold compensation switching element, and the initialization switching element are controlled to an off state.

4. The display device according to claim 1, wherein a control terminal of the write control switching element is connected to any one of the plurality of scanning signal lines, and a control terminal of the first light emission control switching element is connected to any one of the plurality of light emission control lines.

5. The display device according to claim 4, further comprising:

a plurality of first-type logical sum signal lines individually corresponding to the plurality of scanning signal lines; and a first-type logical sum drive circuit configured to apply, to each of the plurality of first-type logical sum signal lines, a signal of a logical sum of a signal of the scanning signal line corresponding to the first-type logical sum signal line and a signal of the scanning signal line selected immediately before selecting the corresponding scanning signal line, wherein a control terminal of the threshold compensation switching element is connected to the first-type logical sum signal line corresponding to any one of the plurality of scanning signal lines, and a control terminal of the initialization switching element is connected to the scanning signal line selected immediately before selecting any one of the plurality of scanning signal lines.

6. The display device according to claim 4, further comprising:

a plurality of second-type logical sum signal lines individually corresponding to the plurality of scanning signal lines; and a second-type logical sum drive circuit configured to apply, to each of the plurality of second-type logical sum signal lines, a signal of a logical sum of a signal of the scanning signal line selected immediately before selecting the scanning signal line corresponding to the second-type logical sum signal line and a signal of the light emission control line corresponding to the corresponding scanning signal line, wherein a control terminal of the second light emission control switching element is connected to the second-type logical sum signal line corresponding to any one of the plurality of scanning signal lines, and a control terminal of the initialization switching element is connected to the scanning signal line selected immediately before selecting any one of the plurality of scanning signal lines.

7. The display device according to claim 4, further comprising:

a plurality of first-type logical sum signal lines individually corresponding to the plurality of scanning signal lines; and a first-type logical sum drive circuit configured to apply, to each of the plurality of first-type logical sum signal lines, a signal of a logical sum of a signal of the scanning signal line corresponding to the first-type logical sum signal line and a signal of the scanning signal line selected immediately before selecting the corresponding scanning signal line, wherein control terminals of the threshold compensation switching element and the initialization switching element are connected to the first-type logical sum signal line corresponding to any one of the plurality of scanning signal lines.

8. The display device according to claim 4, further comprising:

a plurality of second-type logical sum signal lines individually corresponding to the plurality of scanning signal lines; and a second-type logical sum drive circuit configured to apply, to each of the plurality of second-type logical sum signal lines, a signal of a logical sum of a signal of the scanning signal line selected immediately before selecting the scanning signal line corresponding to the second-type logical sum signal line and a signal of the light emission control line corresponding to the corresponding scanning signal line, wherein a control terminal of the second light emission control switching element is connected to the second-type logical sum signal line corresponding to any one of the plurality of scanning signal lines.

9. The display device according to claim 4, wherein, in the scanning signal line drive circuit, a plurality of scanning signals are applied to each of the plurality of scanning signal lines such that the plurality of scanning signal lines are sequentially selected in predetermined periods, the plurality of scanning signals being sequentially activated in each predetermined period, and in the light emission control circuit, for each of the plurality of scanning signal lines, a light emission control signal is applied to the light emission control line corresponding to the scanning signal line, the light emission control signal being a signal where a non-light emission period including a select period of the scanning signal line and a select period of a preceding scanning signal line, which is a scanning signal line selected immediately before selecting the scanning signal line, is inactive, and where a light emission period including a select period of a scanning signal line other than the scanning signal line and the preceding scanning signal line is active.

10. The display device according to claim 1, wherein the first power source line is a high voltage-side power source line, and the second power source line is a low voltage-side power source line, and the drive transistor is a P-channel transistor.

11. A method for driving a display device including a plurality of data signal lines, a plurality of scanning signal lines intersecting the plurality of data signal lines, a plurality of light emission control lines individually corresponding to the plurality of scanning signal lines, first and second power source lines, an initialization voltage supply line, and a plurality of pixel circuits arranged in a matrix along the plurality of data signal lines and the plurality of scanning signal lines, the method for driving a display device comprising:

an initialization step of initializing each pixel circuit, wherein each pixel circuit comprises:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and an initialization switching element, a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, and the second conduction terminal via the threshold compensation switching element, the first terminal of the display element is connected to the initialization voltage supply line via the initialization switching element, and a second terminal of the display element is connected to the second power source line, and in the initialization step, when a holding voltage of the holding capacitor is to be initialized, the threshold compensation switching element, the second light emission control switching element, and the initialization switching element are controlled to an on state, and the write control switching element and the first light emission control switching element are controlled to an off state.

12. The method for driving a display device according to claim 11, further comprising:

a data writing step in which, when writing a voltage of any one of the plurality of data signal lines to the holding capacitor as a data voltage, the write control switching element and the threshold compensation switching element are controlled to an on state, and the first light emission control switching element and the second light emission control switching element are controlled to an off state.

13. The method for driving a display device according to claim 12, further comprising:

a lighting step in which, when the display element is to be driven based on the holding voltage of the holding capacitor, the first light emission control switching element and the second light emission control switching element are controlled to an on state, and the write control switching element, the threshold compensation switching element, and the initialization switching element are controlled to an off state.

* * * * *